United States Patent [19]

Teske

[11] Patent Number: 4,770,110

[45] Date of Patent: Sep. 13, 1988

[54] CONVEYOR FOR REMOVING BURNT RESIDUE FROM AN INCINERATOR

[76] Inventor: Lothar Teske, Hegelstr. 15, D-5000 Köln, Fed. Rep. of Germany

[21] Appl. No.: 86,724

[22] Filed: Aug. 17, 1987

[51] Int. Cl.[4] ..... F23J 1/02

[52] U.S. Cl. ..... 110/259; 110/165 R; 110/171

[58] Field of Search ..... 110/165 R, 171, 269, 110/271, 273, 329, 330, 259

[56] References Cited

U.S. PATENT DOCUMENTS

| | | | |
|---|---|---|---|
| 3,133,804 | 5/1964 | Hardgrove | 110/165 R X |
| 3,980,425 | 9/1976 | Pinettes et al. | 110/269 X |
| 4,533,856 | 8/1985 | Malone | 110/330 X |
| 4,545,305 | 10/1985 | Howard et al. | 110/171 X |

*Primary Examiner*—Edward G. Favors
*Attorney, Agent, or Firm*—Herbert Dubno

[57] ABSTRACT

A conveyor used in combination with an incinerator that burns refuse into residue including hard objects has a trough having a lower upstream portion underneath the incinerator and positioned to receive the residue therefrom and an upper downstream portion spaced therefrom in a longitudinal transport direction. A body of quenching liquid fills at least the downstream portion of the trough to a liquid level. Respective upstream and downstream wheels at the upstream and downstream ends of the trough rotatable about generally parallel and horizontal axes transverse of the trough and direction support a chain formed of a succession of linked-together plates and having catenary-like upper and lower sketches both of which are in the upstream portion below the liquid level. Thus residue issuing from the incinerator falls into the liquid, is quenched, and lands on the upper chain stretch. A drive connected to at least one of the wheels rotates both the wheels and advances the chain with its upper stretch moving in the transport direction to convey the residue that has fallen onto the upper stretch up out of the liquid to the downstream trough end.

10 Claims, 2 Drawing Sheets

CONVEYOR FOR REMOVING BURNT RESIDUE FROM AN INCINERATOR

FIELD OF THE INVENTION

The present invention relates to a conveyor for removing burnt residue including ash from an incinerator or furnace. More particularly this invention concerns the removal of burnt residue from a garbage or scrap incinerator.

BACKGROUND OF THE INVENTION

Burnt residue including ash and hard objects is typically removed from the downwardly opening outlet of an incinerator, furnace or the like by a conveyor of the type described in U.S. Pat. No. 4,440,097 having a trough having a lower upstream portion underneath the incinerator and positioned to receive the residue therefrom and an upper downstream portion spaced therefrom in a longitudinal transport direction. A body of quenching liquid in the downstream portion of the trough serves to cool and quench the hot residue that is dumped into the trough. Respective upstream and downstream wheels at the upstream and downstream ends of the trough are rotatable about generally parallel and horizontal axes transverse of the trough and direction and support a chain having an upper stretch and a lower stretch. The trough has a longitudinal partition or floor extending between the upper and lower chain stretches and this upper stretch has pushers which drag material that lands on this floor in the transport direction up out of the body of liquid.

Such an arrangement works very well with residue that does not include massive objects, like chunks of metal or the like as can be found in the residue of burnt refuse or trash. Such hard and massive objects can fall through the body of water with enough force to dent and damage the floor of the trough. Not only does this damage the trough, but it can lead to material jamming and causing excessive tension on the chain, breaking it. If the floor is pierced or the chain broken, the entire piece of equipment must be taken out of service for repairs that are difficult at best and that always entail emptying the trough.

OBJECTS OF THE INVENTION

It is therefore an object of the present invention to provide an improved conveyor for carrying burnt residue including hard objects from an incinerator or the like.

Another object is the provision of such a conveyor for carrying burnt residue including hard objects from an incinerator or the like which overcomes the above-given disadvantages, i.e. which is not readily damaged, which is not subject to jamming, and which is easy to repair if it is damaged.

SUMMARY OF THE INVENTION

The conveyor according to this invention is used in combination with an incinerator that burns refuse into residue including hard objects and has a trough having a lower upstream portion underneath the incinerator and positioned to receive the residue therefrom and an upper downstream portion spaced therefrom in a longitudinal transport direction. A body of quenching liquid fills at least the downstream portion of the trough to a liquid level. Respective upstream and downstream wheels at the upstream and downstream ends of the trough rotatable about generally parallel and horizontal axes, transverse of the trough and direction, support a chain formed of a succession of linked-together plates and having catenary-like upper and lower stretches both of which are in the upstream portion below the liquid level. Thus residue issuing from the incinerator falls into the liquid, is quenched, and lands on the upper chain stretch. A drive connected to at least one of the wheels rotates both the wheels and advances the chain with its upper stretch moving in the transport direction to convey the residue that has fallen onto the upper stretch up out of the liquid to the downstream trough end.

Thus with the system of this invention the residue, including any hard objects in it, will fall onto the plates of the upper chain stretch. These plates have some give since they are suspended under the water from the chain ends so that they are not likely to be damaged. Even if they are, the damage is not likely to affect operation of the device, and if it is extreme and causes a problem the replacement of a plate is a relatively simple task that can be undertaken without even emptying the trough.

According to this invention one of the wheels, normally the above-liquid drive wheel, is braced by shock absorbers so that even if a very heavy object does fall on the upper chain stretch, the strain created thereby is taken up resiliently.

Further, according to this invention the trough is provided with guides holding the lower stretch down below the upper stretch. The trough has sides and a floor and the guides are mounted on the sides of the trough and engage downward against longitudinal edges of the lower stretch. In this manner any engagement of the oppositely moving upper and lower stretches of the chain is impossible.

The chain according to this invention is comprised mainly of two endless succession of links spanned over the wheels and extending parallel to but spaced transversely from each other, a multiplicity of transverse pins extending transversely between and pivotally interconnecting the links of each succession together while connecting the successions transversely together, and a multiplicity of plates having upstream and downstream edges pivoted on the pins to form a continuous belt and side edges confronting the respective successions of links.

According to a further feature of this invention each plate has at each side edge a vertically extending side part longitudinally overlapping the side parts of the adjacent plates. The side parts of the upper stretch project upward and the side parts of the lower stretch project downward. In addition at least some of the plates are provided between the respective side parts with projecting pusher bars with the bars of the upper stretch projecting upward from the respective plates and the lower-stretch bars projecting downward. Each such bar extends transversely fully between the respective side parts.

To prevent the trough from silting up with various fines, at least some of the plates are provided between the respective side parts with projecting flexible scrapers. The scrapers of the upper stretch project upward from the respective plates and the scrapers of the lower stretch engage the trough. Thus, these scrapers keep the trough clean.

In order for the conveyor according to this invention to service a plurality of incinerators or the like and to move into a position offset from these incinerators, it is provided with means for moving the trough, chain, liquid, and wheels transversely of the trough along a battery of incinerators and out from underneath same.

DESCRIPTION OF THE DRAWING

The above and other objects, features, and advantages will become more apparent from the following, reference being made to the accompanying drawing in which.

SPECIFIC DESCRIPTION

Figure 1:
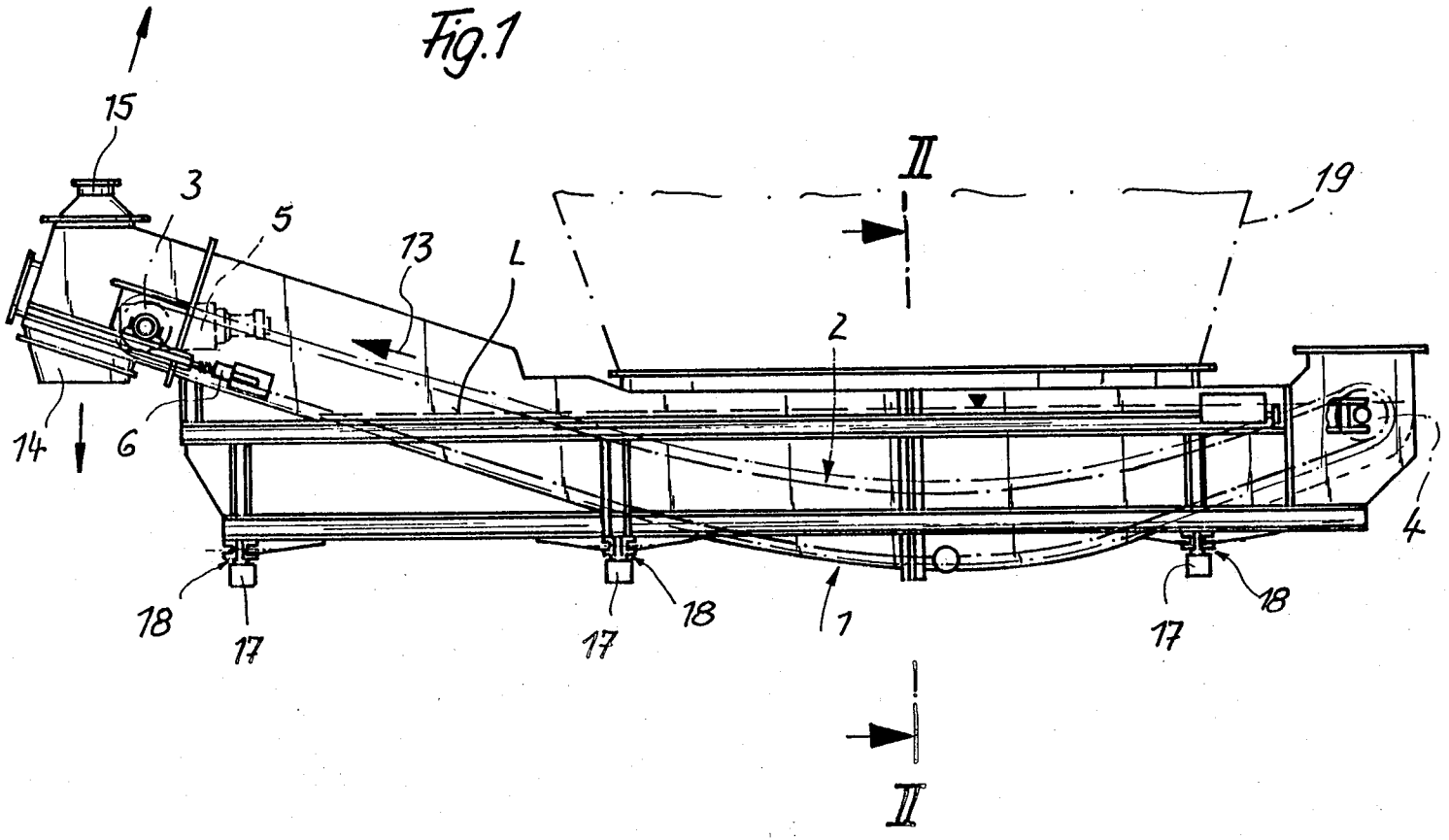
FIG. 1 is a partly diagrammatic side view of the conveyor according to the present invention.
Figure 2:
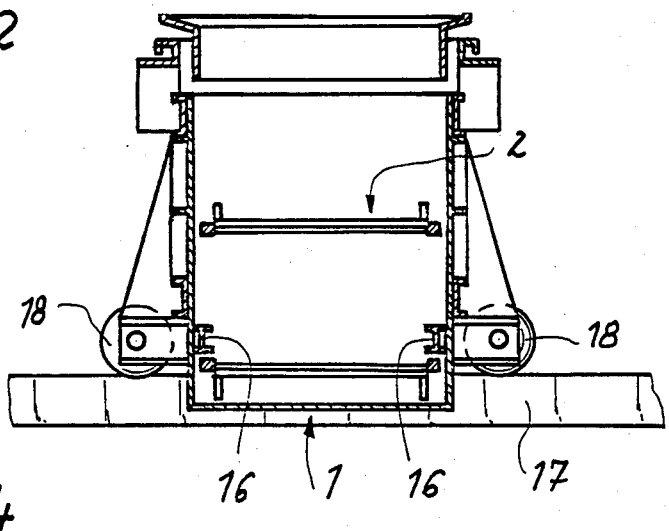
FIG. 2 is a large-scale vertical cross section taken along line II—II of FIG. 1.

As seen in FIGS. 1 and 2 the system of this invention basically comprises a U-shaped and -section trough 1 in which is provided an endless conveyor chain 2 spanned over drive sprockets 3 at its downstream end relative to a material-transport direction 13 and idler sprockets 4 at its upstream end. The trough 1 is filled with water to a level L below at least the drive wheels 3. A motor 5 above the level L powers these wheels 3 to move the chain 2 so its upper stretch moves in the direction 13, and spring-loaded and/or hydraulic shock absorbers 6 are braced against these wheels 3 to move them away from the wheels 4 and keep tension on the chain 2. In spite of this tension, however, the chain 2 hangs like a catenary between the wheels 3 and 4 with its upper and lower stretches parallel. The lower stretch of the chain 2 runs directly on the complementarily shaped floor of the trough 1 and is held down in this position by guide rails 16 (FIG. 2) extending along the side walls of the trough 1 just above its floor.

As seen in FIG. 2 the trough 1 is carried on rollers or wheels 18 for movement along rails 17 extending transversely of the conveyor along underneath the outlets of scrap incinerators shown schematically at 19 in FIG. 1. Thus the trough 1 can be moved into a position under any one of these incinerator outlets 19. It is open upward in the region that is alignable with the outlets 19 but is tubular and closed downstream therefrom. The extreme downstream end of the trough 1 has a downwardly open outlet for the solid material conveyed by the chain 2 from the incinerator outlet 19 it is under and an upwardly open outlet 15 from which vapors are drawn. Thus the conveyor can be moved under whichever incinerator 19 needs emptying and for servicing can be moved out from underneath the battery of incinerators altogether. Since the burning process is relatively long and the emptying process relatively short, it is therefore possible for one such conveyor to service a plurality of incinerators.

Figure 4:
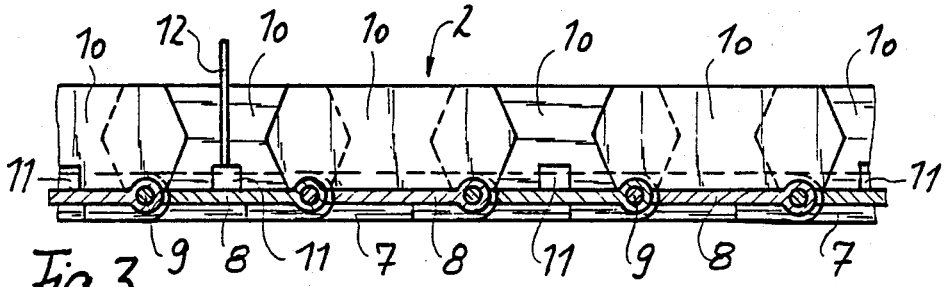
FIG. 4 is a vertical longitudinal section taken along line IV—IV of FIG. 3.
Figure 3:
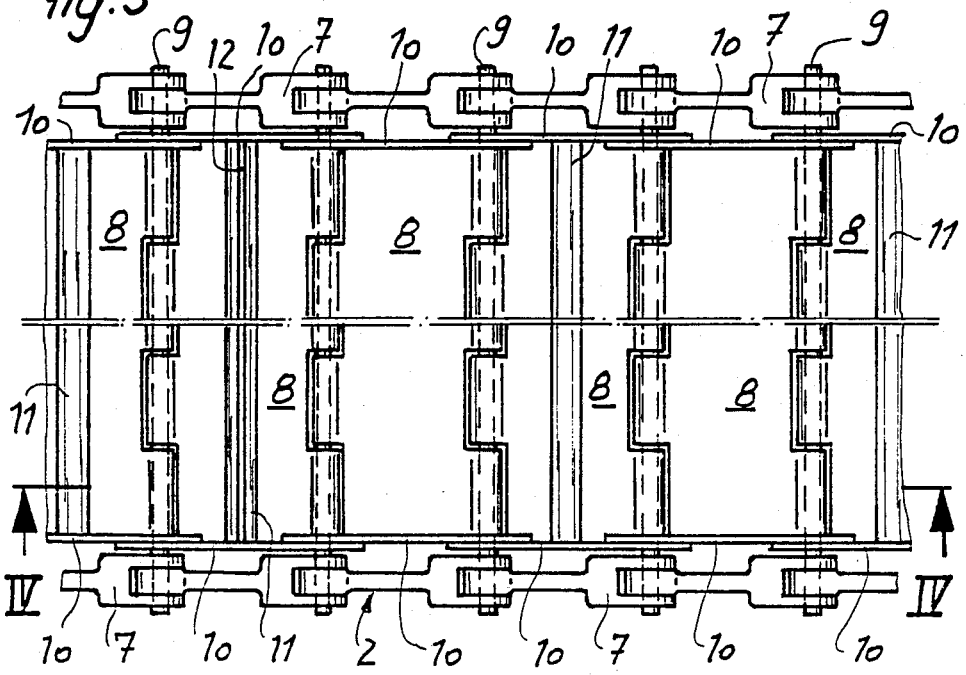
FIG. 3 is a larger-scale top view of a detail of the conveyor.

FIGS. 3 and 4 show the chain 2 in more detail. It is formed by two endless succession of chain links 7 connected together by axle pins 9 that also pass through rectangular plates 8 having upstream and downstream edges formed like hinges with interleaved knuckles through which these pins 9 pass. Thus the plates 8 form a fairly continuous flat surface that is below the liquid level L underneath the incinerator 19 and that is sufficiently continuous that no large pieces of the material being dumped from this incinerator 19 can pass between them.

In addition each plate 8 is formed at each of its sides with a built up side part or wall 10, with the sides 10 of every other plate lying within those of the flanking plates and the sides 10 overlapping in the direction 13. Thus the plates 8 form a fairly continuous upwardly open trough of their own along the upper stretch. To ensure that material dropped into the upper stretch of the chain 2 does not slip back down along it as it moves up out of the water and to pick up material floating on the liquid at the upstream wheels 4 where the chain 2 momentarily rises above the level L, every second or third plate 8 is provided with a pusher rib 18 extending transversely between its side plates 10 and projecting up from the plate 8 by a distance equal to around one-quarter of the height of the side. Similarly some of the plates 8 are provided on the respective pushers 11 with scrapers 12 that project well up beyond the tops of the side plates 10. Whereas the pushers 11 are rigid, the scrapers 12 are flexible, being formed of spring steel. Their height is such that they scrape along the floor of the trough 1 as the lower stretch is pulled opposite the direction 13 from the drive sprockets 3 to the idler sprockets 4.

With this system, therefore, material dumped from the incinerator 19 into the trough 1 will be largely caught after passing through the water by the upper stretch of the chain 2, which is moving continuously toward the outlet 14. What little of the material from the incinerator 19 gets past the upper stretch of the chain 1 will temporarily settle to the floor of the conveyor trough 1 where it will be scraped to the upstream end and then picked up and conveyed out. Thus hard and lumpy objects will be caught on the conveyor chain 2 which is very sturdily build and which has some give. As the wet bulky mass of the material being dumped in is moved up and out of the liquid body it will pick up and entrain away any fines floating on the surface, and the material will have some amount of time to dewater before the chain 2 reverses at the drive sprockets 3 and dumps this material out through the outlet 14.

I claim:

1. In combination with an incinerator that burns refuse into residue including hard objects, a conveyor comprising:

a trough having a lower upstream portion underneath the incinerator and positioned to receive the residue therefrom and an upper downstream portion spaced therefrom in a longitudinal transport direction;

a body of quenching liquid in the downstream portion of the trough and having a liquid level;

respective upstream and downstream wheels at the upstream and downstream ends of the trough rotatable about generally parallel and horizontal axes transverse of the trough and direction;

a chain spanned between the upstream and downstream wheels, supported exclusively by said wheels, mounted resiliently, formed of a succession of linked-together plates, and having catenary-like upper and lower stretches both of which are in the upstream portion below the liquid level, whereby residue issuing from the incinerator falls into the liquid and then onto the upper chain stretch;

curved guide rails extending along sidewalls of the trough holding the lower stretch down below the upper stretch; and means connected to at least one of the wheels for rotating both the wheels and advancing the chain with its upper stretch moving in the transport direction to convey the residue that has fallen onto the upper stretch up out of the liquid to the downstream trough end.

2. The burnt-refuse conveyor defined in claim 1 wherein the trough has sides and a floor and the guides are mounted on the sides of the trough and engage downward against longitudinal edges of the lower stretch.

3. The burnt-refuse conveyor defined in claim 1 wherein the chain is comprised mainly of:

two endless succession of links spanned over the wheels and extending parallel to but spaced transversely from each other;

a multiplicity of transverse pins extending transversely between and pivotally interconnecting the links of each succession together while connecting the successions transversely together; and a multiplicity of plates having upstream and downstream edges pivoted on the pins to form a continuous belt and side edges confronting the respective successions of links.

4. The burnt-refuse conveyor defined in claim 3 wherein each plate has at each side edge a vertically extending side part longitudinally overlapping the side parts of the adjacent plates, the side parts of the upper stretch projecting upward and the side parts of the lower stretch projecting downward.

5. The burnt-refuse conveyor defined in claim 4 wherein at least some of the plates are provided between the respective side parts with projecting pusher bars, the bars of the upper stretch projecting upward from the respective plates.

6. The burnt-refuse conveyor defined in claim 5 wherein each pusher bar extends transversely fully between the respective side parts.

7. The burnt-refuse conveyor defined in claim 4 wherein at least some of the plates are provided between the respective side parts with projecting flexible scrapers, the scrapers of the upper stretch projecting upward from the respective plates and the scrapers of the lower stretch engaging the trough.

8. The burnt-refuse conveyor defined in claim 1, further comprising means for moving the trough, chain, liquid, and wheels transversely of the trough.

9. The burnt-refuse conveyor defined in claim 1 further comprising shock absorbers pushing one of the wheels away from the other and thereby maintaining tension in the chain.

10. In combination with an incinerator that burns refuse into residue including hard objects, a conveyor comprising:

a trough having a lower upstream portion underneath the incinerator and positioned to receive the residue therefrom and an upper downstream portion spaced therefrom in a longitudinal transport direction;

a body of quenching liquid in the downstream portion of the trough and having a liquid level;

respective upstream and downstream wheels at the upstream and downstream ends of the trough rotatable about generally parallel and horizontal axes transverse of the trough and direction;

a chain spanned between the upstream and downstream wheels, supported exclusively between said wheels, mounted resiliently therebetween, and having a catenary-like upper and lower stretches both of which are in the upstream portion below the liquid level, whereby residue issuing from the incinerator falls into the liquid and then onto the upper chain stretch, the chain including two endless succession of links spanned over the wheels and extending parallel to but spaced transversely from each other, a multiplicity of transverse pins extending transversely between and pivotally interconnecting the links of each succession together while connecting the successions transversely together, and a multiplicity of plates having upstream and downstream edges pivoted on the pins to form a continuous belt and side edges confronting the respective successions of links, each plate having at each side edge a vertically extending side part longitudinally overlapping the side parts of the adjacent plates, the side parts of the upper stretch projecting upward and the side parts of the lower stretch projecting downward;

shock absorbers pushing one of the wheels away from the other and thereby maintaining tension in the chain;

curved guides in the trough holding the lower stretch down below the upper stretch; and means connected to at least one of the wheels for rotating both the wheels and advancing the chain with its upper stretch moving in the transport direction to convey the residue that has fallen onto the upper stretch up out of the liquid to the downstream trough end.

* * * * *